US005697146A

United States Patent [19]

Inoue et al.

[11] Patent Number: 5,697,146

[45] Date of Patent: Dec. 16, 1997

[54] APPARATUS FOR CRIMPING TERMINAL TO ELECTRICAL WIRE

[75] Inventors: Toshihiro Inoue; Masao Igarashi; Kazuhiko Takada, all of Shizuoka, Japan

[73] Assignee: Yazaki Corporation, Tokyo, Japan

[21] Appl. No.: 576,083

[22] Filed: Dec. 21, 1995

[30] Foreign Application Priority Data

Dec. 28, 1994 [JP] Japan ..... 6-328825

[51] Int. Cl.[6] ..... H01R 43/048

[52] U.S. Cl. ..... 29/753; 29/33 M; 29/405; 29/863; 72/19.1; 72/21.3; 72/712

[58] Field of Search ..... 29/33 M, 405, 29/703, 705, 715, 753, 863, 593; 72/13.2, 19.1, 413, 443, 446, 16.5, 18.3, 21.3, 712; 73/862.623; 100/48; 318/567

[56] References Cited

U.S. PATENT DOCUMENTS

| | | | |
|---|---|---|---|
| 5,046,241 | 9/1991 | Ricard | 29/863 |
| 5,069,060 | 12/1991 | Ishii | 72/443 |
| 5,079,489 | 1/1992 | Ishii | 318/567 X |
| 5,084,960 | 2/1992 | Yeomans | 29/753 |
| 5,115,735 | 5/1992 | Gloe et al. | 100/48 X |
| 5,129,317 | 7/1992 | Gloe et al. | 72/21.3 X |
| 5,271,254 | 12/1993 | Gloe et al. | 29/705 X |
| 5,517,749 | 5/1996 | Zuin | 72/413 X |

FOREIGN PATENT DOCUMENTS

| | | | |
|---|---|---|---|
| 564411 | 10/1993 | European Pat. Off. | 29/753 |
| 3540083 | 5/1987 | Germany | 29/753 |
| 3-189037 | 8/1991 | Japan . | |
| 5-29055 | 2/1993 | Japan . | |
| 5-29056 | 2/1993 | Japan . | |
| 6-25911 | 7/1994 | Japan . | |

*Primary Examiner*—Peter Vo

*Attorney, Agent, or Firm*—Armstrong, Westerman, Hattori, McLeland, & Naughton

[57] ABSTRACT

An apparatus for crimping a terminal includes a crimper vertically reciprocating to crimp electric terminals to conductors of a striped wire, and anvil opposing the crimper, and an operating mechanism for vertically reciprocating the crimper. The operating mechanism has a piston-crank apparatus to vertically reciprocate a ram attached to the crimper and a servo-motor connected to a circular plate in the piston-crank mechanism by way of a reduction gear. The operating mechanism also has a control device that stops the servo-motor for a given time period when the crimper is positioned at its lowest position to prevent spring-back of the crimper material.

9 Claims, 11 Drawing Sheets

APPARATUS FOR CRIMPING TERMINAL TO ELECTRICAL WIRE

BACKGROUND OF THE INVENTION

1. Field of the Invention

This invention relates to an apparatus for crimping a terminal to an electrical wire, which manufactures terminal-equipped wires for configuring a wire harness, or the like.

2. Description of the Prior Art

There has been used for a long time a terminal crimping apparatus provided with a flywheel, as shown in FIG. 9, as one of the instant type for performing the crimping method. In the apparatus, the flywheel 101, driven by a motor (not shown), rotates at a constant speed in the direction of an arrow head, and a crank arm 103 pivotably attached to an off-center pin 102 pivots around a pivot axis 104. Further, the crank arm 103 vertically reciprocates a ram 107 pivotably attached by an axial pin 106 to the crank arm 103 by way of a connection arm 105, which vertically reciprocates a crimper 108 integrally connected to the ram 107. Thereby, the crimper 108 and a cooperative anvil 109 compress and crimp a stripped wire end w of a wire W to a barrel c of a terminal C.

The above-mentioned flywheel-type crimping apparatus is suitable for mass production because the crimper 108 vertically reciprocates with higher speeds. However, as the crimper 108 passes instantaneously its bottom dead point (it is not stopped at the bottom dead point), its crimping operation is instantaneous, resulting in the disadvantage of an insufficient tensile strength in the crimped terminals. FIG. 11 shows the relation between time and position of the crimper 108 and explains that a crimping, contacting period $t_0$ of the crimper 108 and the terminal C is only an instant. Moreover, the crimping apparatus has the disadvantages that the size of the flywheel 101 determines the press depth (crimp height), that the motor running cost is large, and that it is difficult to detect an abnormal state during crimping operation. Additionally, a crimp height is not easily adjusted because only a lowest position of the crimper is selected so that the anvil height should be modified in a crimp height adjustment.

Besides, in Japanese Utility Model Publication No. Hei 6-25911, there is provided a crimping apparatus, as shown in FIG. 10, having a crimper 108' vertically moved by the rotation of a lead screw 110. Designated 111 is a servo-motor, 112 a primary wheel, 113 a secondary wheel, and 114 a timing belt.

Nevertheless, the above-mentioned lead-screw-type crimping apparatus also has the disadvantages that a large-scale apparatus is required to obtain a larger crimping load, that its operation speed is normally lower to result in lower productivity, and that many sensors are required to determine whether a terminal is correctly crimped, or otherwise a manual determination is required. Additionally, the screw mechanism is not suitable to a minute adjustment of crimp height.

SUMMARY OF THE INVENTION

In view of the aforementioned drawbacks, an object of the invention is to provide an apparatus for crimping electrical terminals that obtain a sufficient crimping strength while keeping a higher speed in terminal crimping operation and further that is compact in size.

Another object of the present invention is to provide a terminal crimping apparatus having a mechanism capable of easily adjusting crimp heights.

To achieve the above-mentioned object, according to this invention, an apparatus for crimping a terminal to an electrical wire includes a crimper vertically reciprocating to crimp electric terminals to conductors of a stripped wire; an anvil opposing the crimper; and a means for vertically reciprocating the crimper, wherein such means has a piston-crank mechanism to vertically reciprocate a ram attached to the crimper and a servo-motor connected to a circular plate in the piston-crank mechanism by way of a reduction gear.

Preferably, the circular plate in the piston-crank mechanism pivots within the angular range of 0 to 180 degrees by the rotation of the servo-motor.

Referring to operation of the present invention, the forwardly and reversely rotating servo-motor can reciprocate the crimper at a higher speed by way of the piston-crank mechanism, which enables a higher terminal-crimping operation to provide higher productivity.

Further, differing from a conventional flywheel-type or lead-screw-type crimping apparatus, the crimping apparatus according to the present invention is smaller and easier in the adjustment of crimp height by controlling the number of rotations in the servo-motor, that is, by changing the pivoting range of the circular plate.

Moreover, the servo-motor can halt when the crimper is in a crimping position so that terminal barrels are restricted from a spring-back to obtain reliable products with high crimping strength. Besides, controlling descending speeds of the crimper around the crimping position eliminates impulsive noises that are brought about in conventional flywheel-type crimping apparatuses.

DETAILED DESCRIPTION OF PREFERRED EMBODIMENTS

Figure 1:
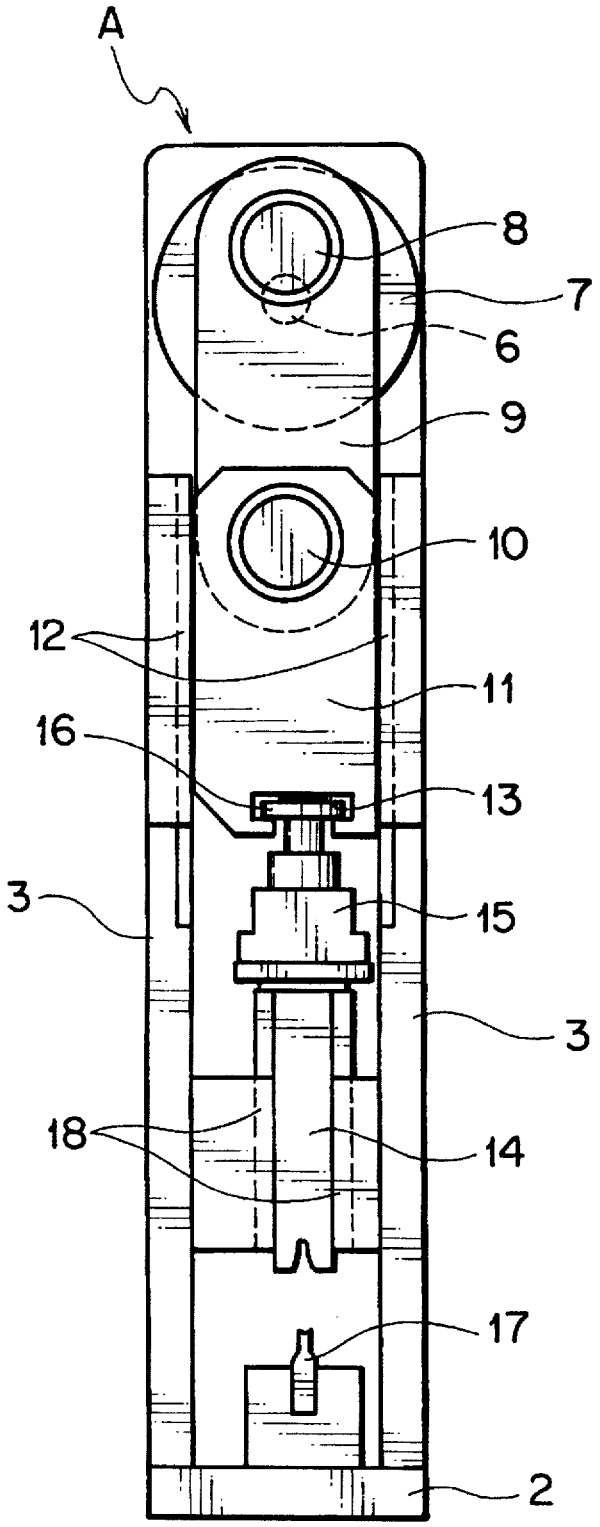
FIG. 1 is the front view showing an embodiment of a terminal crimping apparatus according to this invention.
Figure 2:
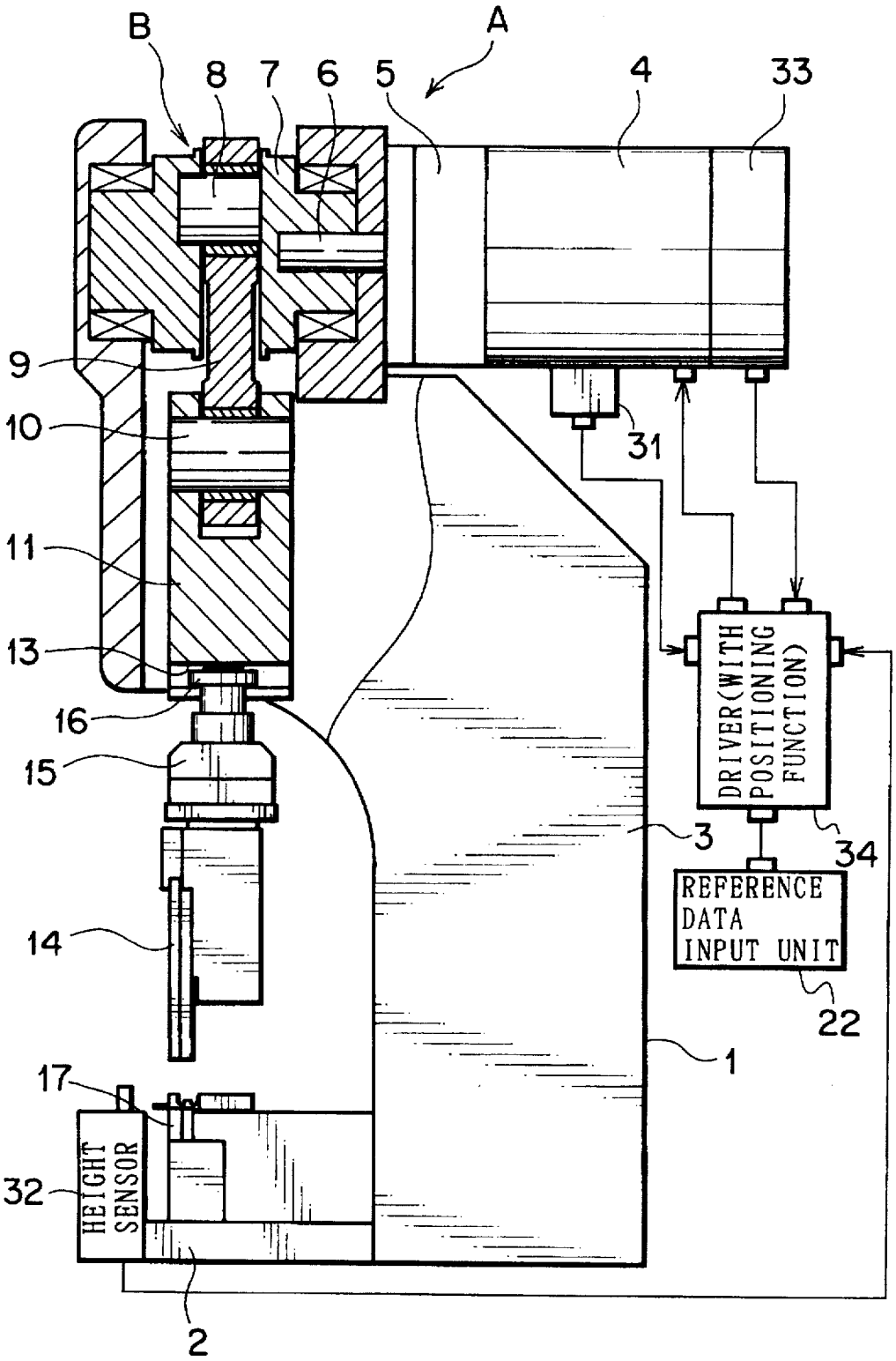
FIG. 2 is a side view of the terminal crimping apparatus in FIG. 1.

In FIGS. 1 and 2, designated as 1 is a casing for a terminal crimping apparatus A according to the present invention, which has a base plate 2 and side plates 3, 3 positioned on each side of the base plate 2. In the rear of, and above both, the side plates 3, 3, there is provided and fixed an electrical servo-motor 4 with a reduction gear 5. The reduction gear 5 has an output axis 6 that axially connects to a circular plate 7 with an off-center pin 8. The off-center pin 8 is slidably axially connected to an upper end portion of a crank arm 9, a lower end portion of which being pivotably axially connected to a ram 11 by way of an axial pin 10. The ram 11 is disposed to slide upward and downward in ram guides 12, 12 provided on inner surfaces of both the side plates 3, 3. The circular plate 7, the crank arm 9, the ram 11 and the ram guides 12, 12 compose a piston-crank mechanism B.

The ram 11, at a lower end thereof, has an engaging recess or slot 13. The engaging recess or slot 13 detachably engages with an enlarged head portion 16 of a crimper holder 15 holding a crimper 14. Just below the crimper 14, an anvil 17 is fixed on the base plate 2 in opposition to the crimper 14. Designated 18 is a guide plate for guiding the crimper holder 15, the guide plate 18 being fixed to an inner surface of the side plate 3 by way of a bracket (not shown).

The servo-motor 4 can rotate forwardly and reversely, which vertically reciprocates the crimper 14 by way of the ram 11 pivotably attached to the crank arm 9 by the piston-crank mechanism B. Further, the servo-motor 4 connects to a driver control device 34 that controls the servo-motor operation. The driver control device 34 connects to a reference data input unit 22 that inputs reference data, such as terminal specifications (or terminal sizes), relative wire sizes, crimp heights (lowest descended positions of the crimper), and loads (electric currents) to be applied to the servo-motor 4. Further, on an output axis (not shown) of the servo-motor 4 there is attached a rotary encoder 33 that detects positions of the crimper 14 based on the extent of rotation of the servo-motor and feeds the information back to the driver control device 34 that reads out the above-mentioned load current.

Designated 32 is a height sensor that senses the height of the crimper 14 just when a terminal is crimped. The sensor 32 is operative to output the sensed height to the driver control device 34 that determines whether the terminal crimping operation is correct. Furthermore, designated 31 is a temperature sensor for sensing the temperature of a coil in the servo-motor 4.

Figure 3:
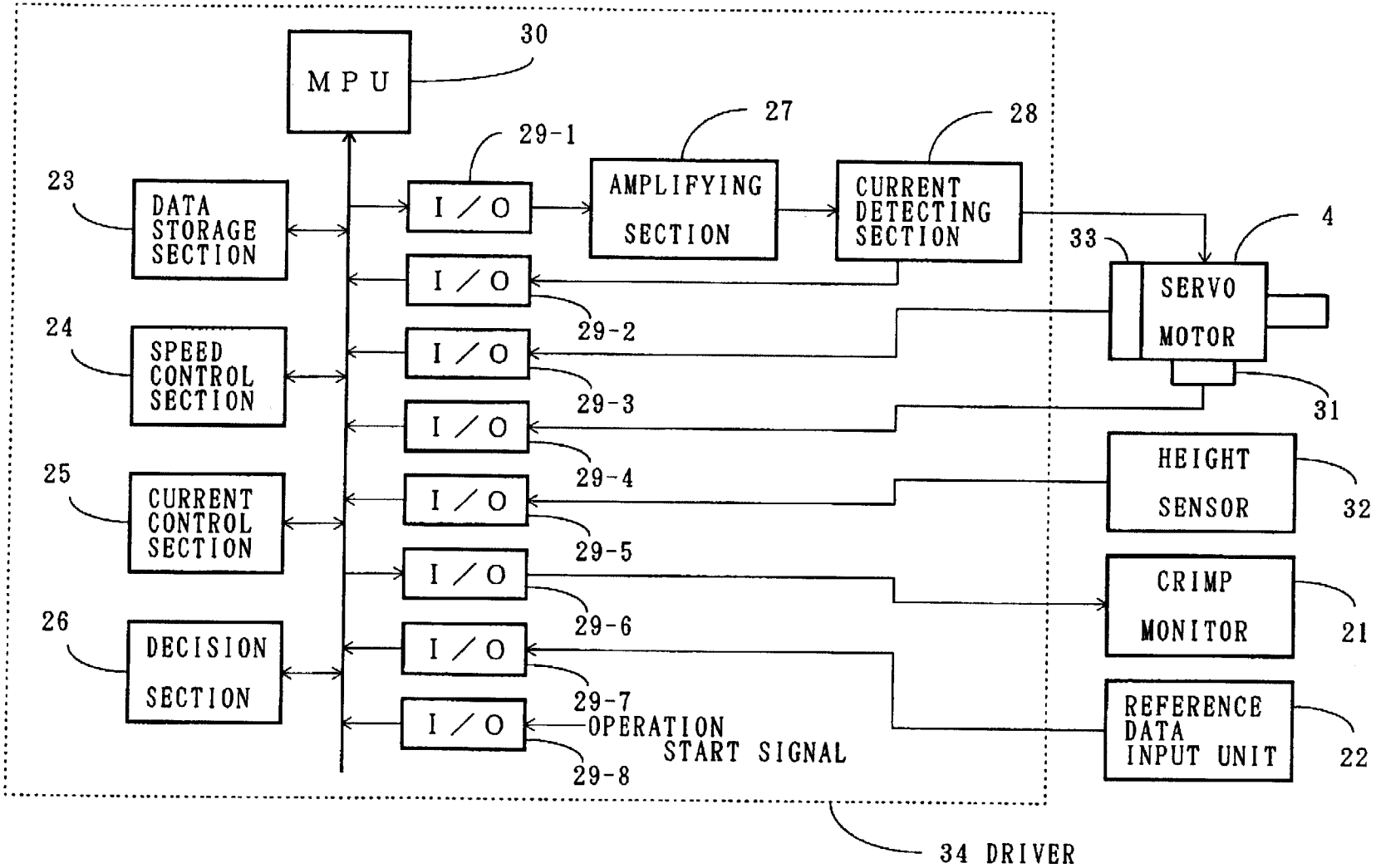
FIG. 3 is a functional block diagram showing a control system of the terminal crimping apparatus in FIG. 1.

FIG. 3 is a functional block diagram of the driver control device 34 that controls the servo-motor 4 in operation. As shown in the figure, the driver control device 34 is integrated as a control circuit, such as a central processing unit, and includes a data storage section 23, a speed control section 24, a current control section 25, a decision section 28, an amplifying section 27, a current detecting section 28, interfaces I/O 29-1 to 29-8, and a microprocessor unit(MPU) 30.

Next, before explaining detailed operation of the embodiment of the present invention, the basic operation of the embodiment is discussed referring to FIGS. 6 and 7.

Figures 6A, 6B, 6C:
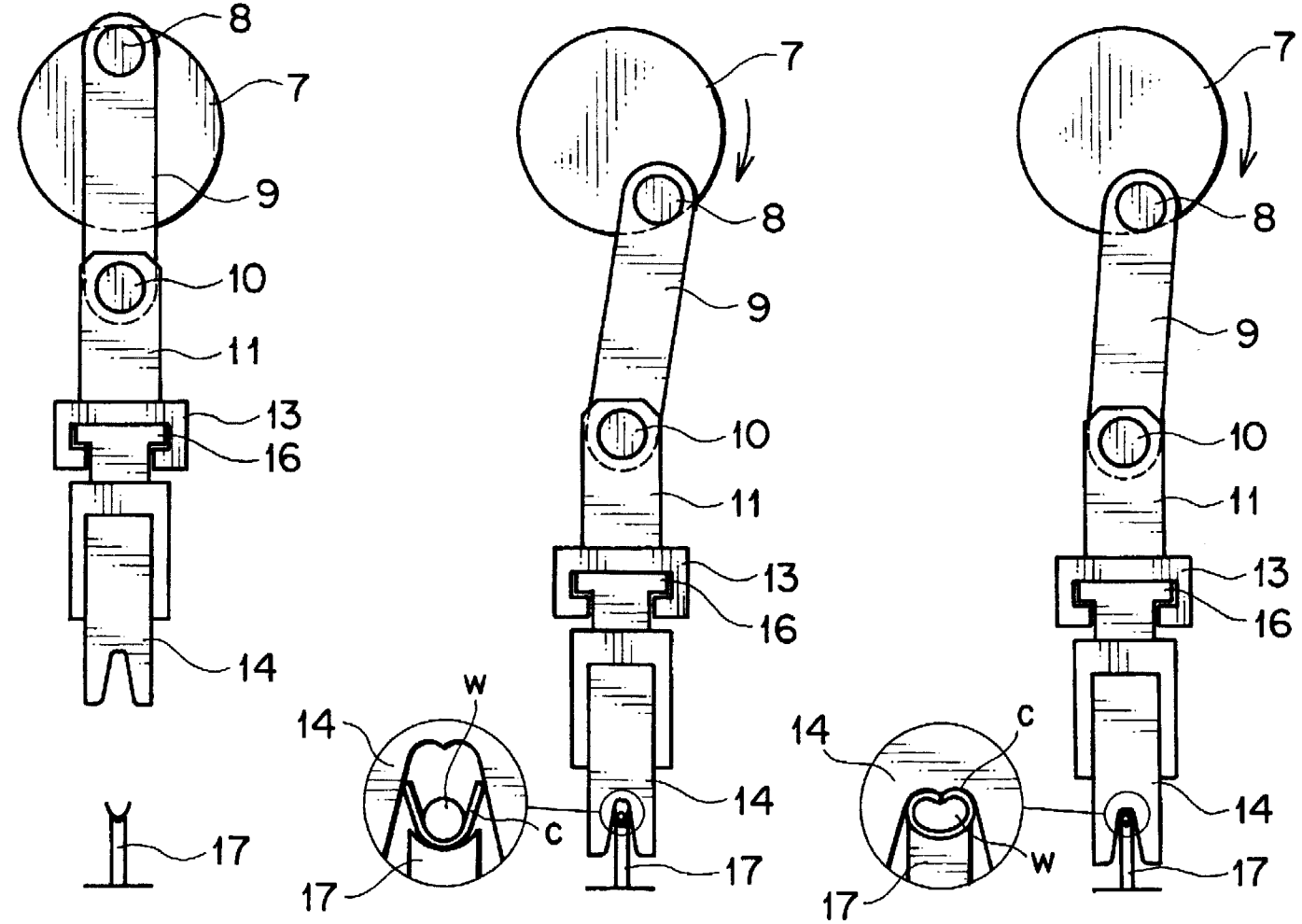
FIGS. 6A, 6B and 6C are illustrations respectively showing various operation steps of the terminal crimping apparatus in FIG. 1.
Figure 7A:
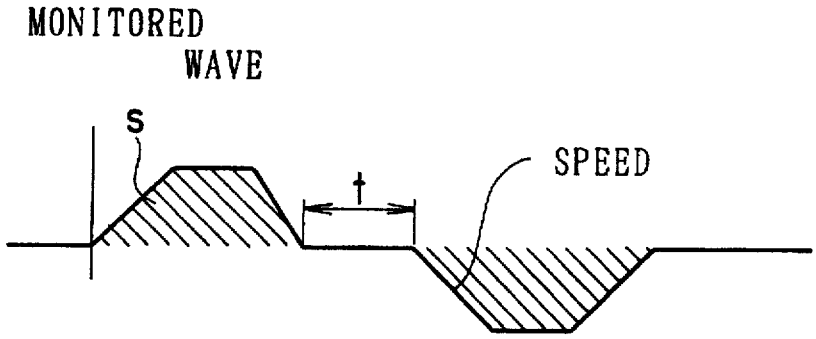
FIG. 7A is a graph showing the relation between time and the vertically reciprocating speed of a crimper in a crimping operation cycle controlled by the control system in FIG. 3.
Figure 7B:
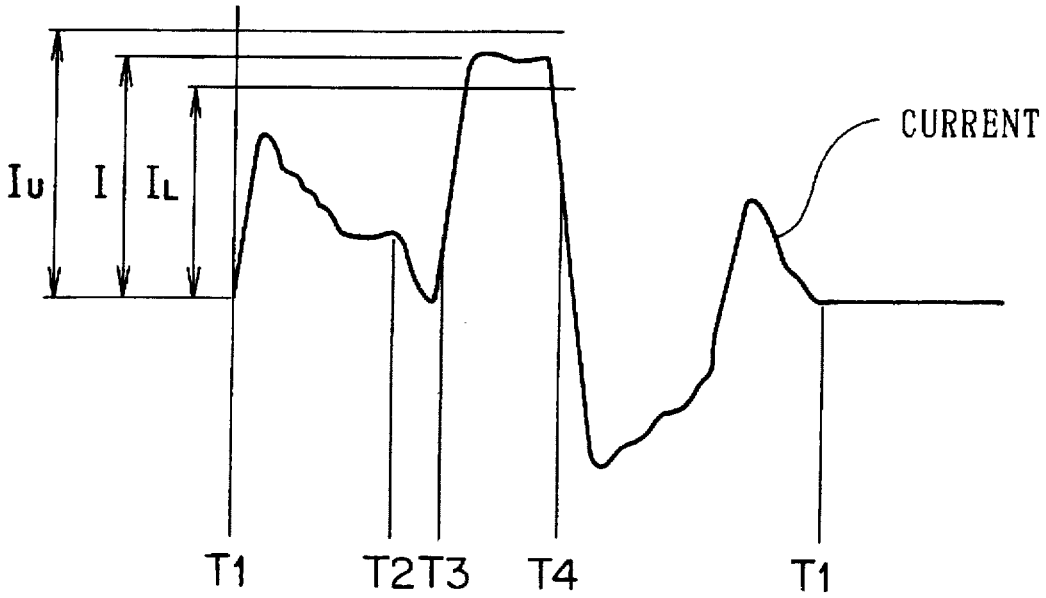
FIG. 7B is a graph showing the relation between time and the motor current of the same.

FIGS. 6A, 6B and 6C are diagrams explaining the operation of the terminal crimping apparatus. FIG. 7A is a graph showing the relation between time and the vertically reciprocating speed of the crimper 14 in the operation. Further, FIG. 7B is a graph showing the relation between time and the current of the servo-motor in the same operation. Besides, the points designated as T1, T2, and T3 in FIGS. 7B correspond to the respective conditions of the apparatus shown in FIG. 6A, 6B, and 6C.

FIG. 6A shows an initial step in the terminal crimping operation, in which the off-center pin 8 on the circular plate 7 is at the highest position, that is, the crimper 14 is at the top dead point. At that time, as shown in FIG. 7A, the descending speed of the crimper 14 is zero and the load current in the servo-motor 4 is also zero.

FIG. 6B shows an initial crimping step, in which the circular plate 7 rotates in the arrow head direction; the off-center pin 8 moves downward; and the crimper 14 has descended at a higher speed before abutting the barrel c of the terminal C. However, the descending speed of the crimper 14 is decelerated and the load current for the servo-motor is reduced prior to the abutment.

FIG. 6C shows a stopping state in which the crimper 14 has stopped at its crimping position, after the circular plate 7 rotates in the arrow head direction so that the off-center pin 8 reaches near its bottom dead point and the crimper 14 and anvil 17 carry out a crimping operation. At that time, as the crimper 14 has been stopping during a stopping period t, the crimper 14 operates to press the barrel c of the terminal C so as to continue to oppose against spring-back of the barrel c. Thereby, the load current reaches to a peak of a maximum rate. The press in the stopping state eliminates the spring-back of the barrel c to obtain a high crimping strength.

After the terminal is crimped, the servo-motor 4 reversely rotates, that is, the circular plate 7 rotates in the reverse direction to the arrow head in FIG. 6C so that the crimper ascends to return to the original state of FIG. 6A.

In FIG. 7A, at the crimping start position, that is, at T2, the descending speed of the crimper 14 is considerably smaller than the speed in which the crimper 14 descends from the top position to the crimping start position. Therefore, there are no impulsive noises generated in the conventional flywheel-type crimping apparatus, which reduces noises to provide an improved working environment.

Further, referring to FIG. 3 again, before the apparatus is operated, the data storage section 23 stores data for operating the crimping apparatus A and data for determining whether terminals are correctly crimped from the reference data input unit 22 by way of I/O 29-7.

The stored data for operating the crimping apparatus A are accelerated speeds of the servo-motor after the servo motor begins to normally rotate at T1, a position of the crimper 14 when the crimper descending speed reaches a uniform rate during the descending of the crimper 14 activated by the motor rotation, a position of the crimper 14 and decelerated speeds of the crimper 14 when the crimper decelerates from the uniform rate at T2, a crimping start position of the crimper 14 at T3, a given time t and a driving current to drive the servo-motor during the given time, accelerated speeds of the servo-motor when the servo-motor begins to reversely rotate to ascend the crimper 14 after a terminal is crimped at T4, a position of the crimper 14 when the crimper ascending speed reaches to another uniform rate, a position of the crimper 14 when the crimper decelerates from another uniform rate, and a stop position of the crimper 14.

Moreover, data of the positions of the crimper 14 are stored as corresponding to output values from the rotary encoder 33 attached to the servo-motor 4.

These data are preliminarily, experimentally obtained respectively for each crimped terminal size to be stored. Further, the data corresponding to plural types of terminals may be preliminarily stored so that any one of the data may be read out when required in a crimping operation.

Moreover, position data of the crimper 14 are stored to correspond to output values of the rotary encoder 33, that is, as corresponding to pivoting angles of the circular plate 7.

Thereby, even for different type of terminals, the crimp height can be promptly modified without changing a height of the anvil 17 in a prior art, and the crimp height can be easily, minutely adjusted when a crimping operation starts, if required.

Further, the data for determining whether terminals are correctly crimped include, as described later in detail, currents IU and IL shown in FIG. 7B or the like. In FIG. 7B, I denotes a detected current when a certain terminal is normally crimped to a corresponding size wire; IU and IL denote an upper limit and a lower limit of the detected current, respectively, IU and IL being determined based on a preliminary test result. The graph of FIG. 17 shows a normal crimping in which I is between IL and IU.

Figure 4:
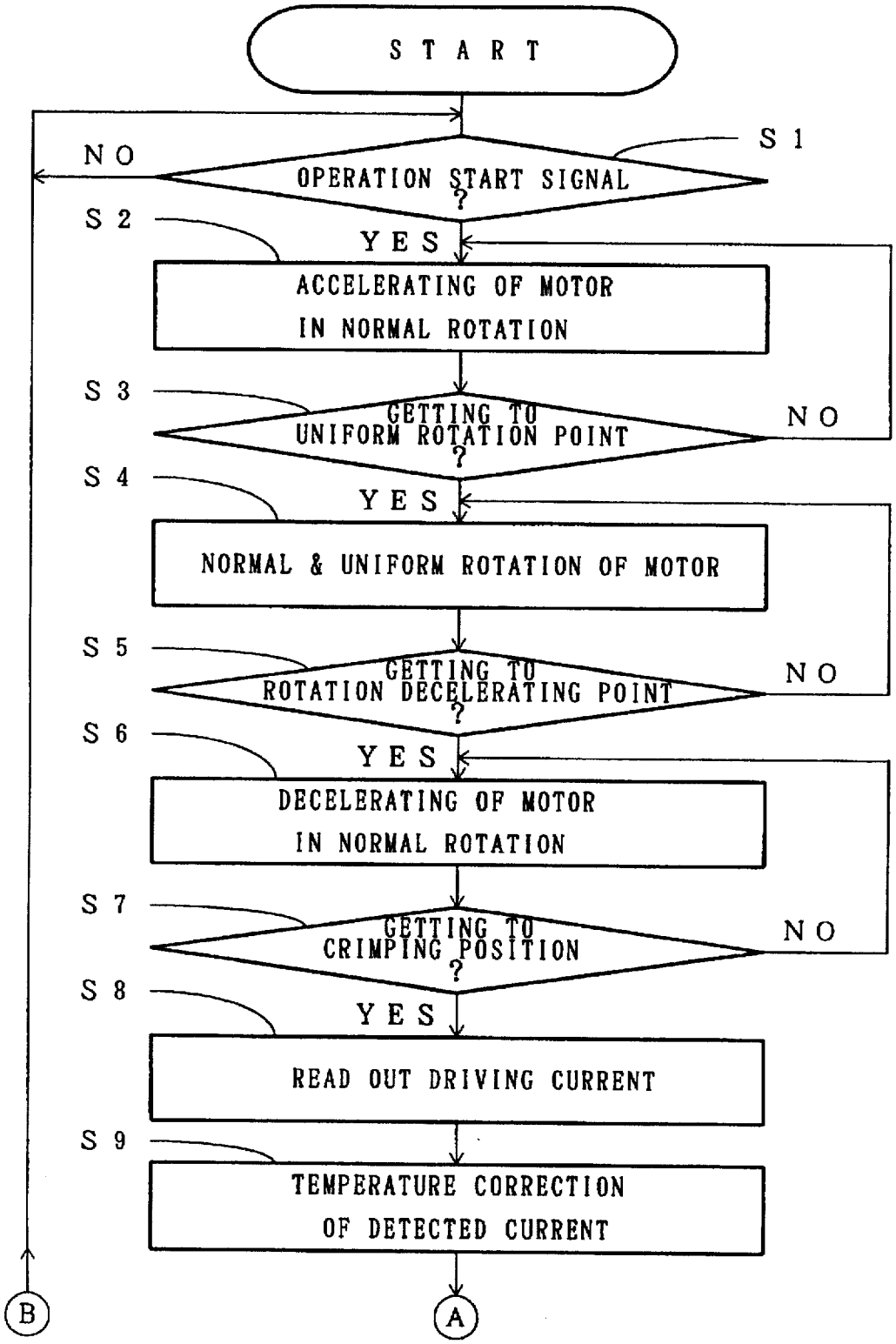
FIG. 4 is a flow chart showing a first part of the operation of the control system of FIG. 3.
Figure 5:
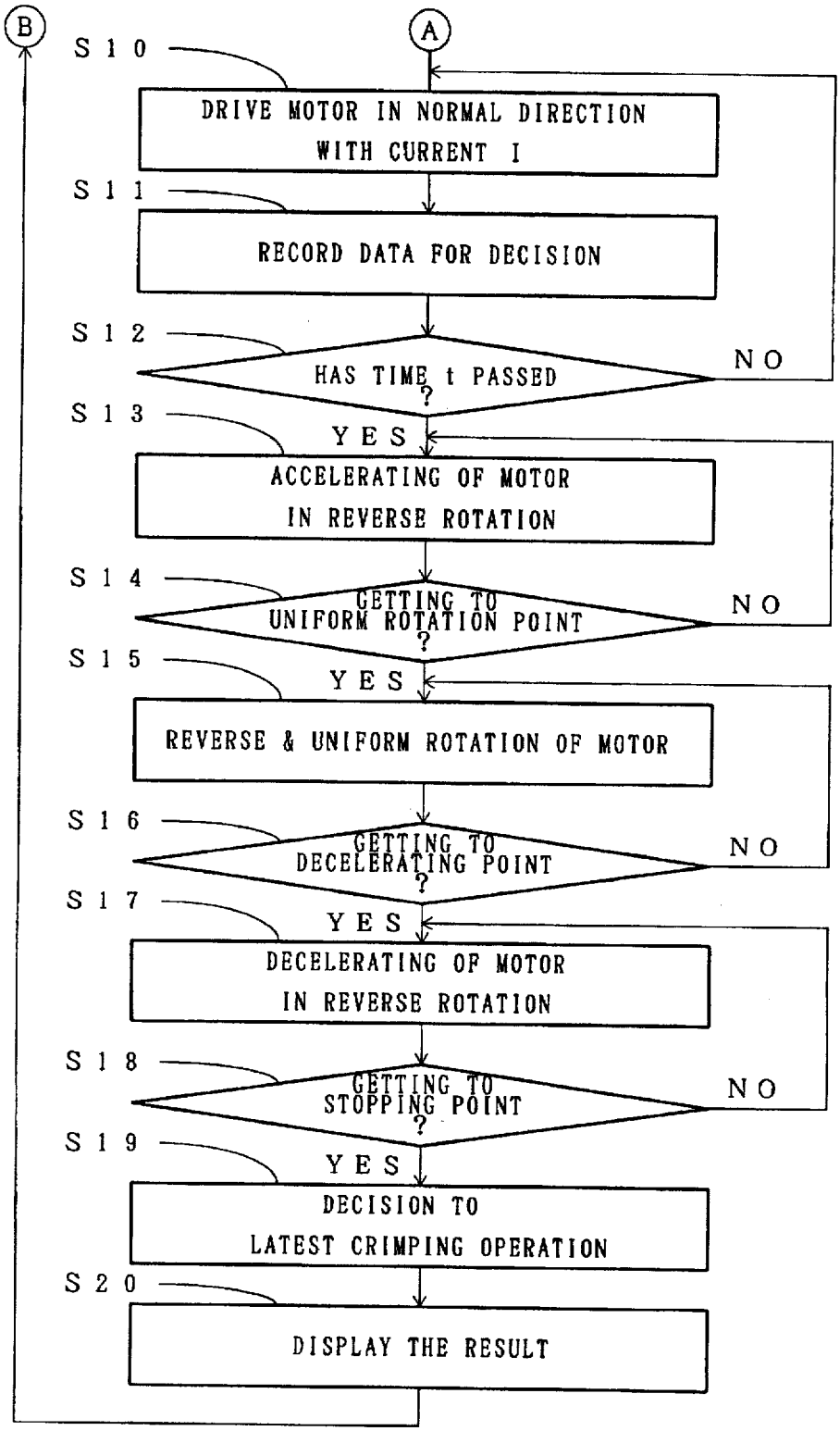
FIG. 5 is a flow chart showing a remaining part of the operation of the control system of FIG. 3.

Next, referring to FIGS. 4 and 5, the operation of the driver 34 will be discussed. FIGS. 4 and 5 show operational flow charts of the driver 34.

In step S1, the speed control section 24 decides whether a starting signal to begin a crimping operation is inputted by way of I/O 29-8, and if the decision is NO, the operation does not start until the decision becomes YES.

In step S2, the speed control section 24 reads out a normally accelerated rotating speed of the servo-motor 4 from the data storage section 23, and outputs a signal to the amplifying section 27 by way of I/O 29-1 so that the amplifying section 27 supplies a current to the servo-motor 4 in such way that the servo-motor 4 rotates at the read out accelerated speed.

The values outputted from the rotary encoder 33 by way of I/O 29-3 are differentiated to obtain rotation speeds of the motor and further the rotation speeds are differentiated to determine rotation accelerations of the motor.

In step S3, The speed control section 24 determines whether a value outputted from the rotary encoder 33 by way of I/O 29-3 becomes equal to the value that is stored in the data storage section 23 and corresponds to a position from which a uniform rotation speed begins. If the decision is NO, step S2 continues to accelerate the motor, while if the decision is YES, a following step S4 makes the motor rotate at a uniform speed.

Further, when step S5 in the speed control section 24 detects the arrival at the deceleration starting position of the motor, the following step S8 decelerates the rotation of the motor. The next step S7 decides whether the crimper has reached the terminal crimping position, and if the decision is YES, the step S7 outputs a corresponding signal to the current control section 25.

In the current control section 25, step S8 reads out a current I stored in the data storage section 23 and which is required by the servo-motor 4 just in a crimping stage. The next step S9 corrects the current I based on a temperature outputted from the temperature sensor 31 by way of I/O 29-4 so that the motor torque becomes equal to the reference value. Further, the following step S10 outputs the current I by way of I/O 29-1.

In the decision section 26, step S11 records the decision reference data in a memory (not shown). The decision reference data will be discussed later in detail.

In the current control section 25, step S12 determines whether the servo-motor 4 has received the current I during the time t, and if the decision is NO, the steps S10 and S11 are executed again.

In the speed control section 24, step S13 reversely rotates the servo-motor 4 with a predetermined acceleration, and, if step S14 decides that the motor rotation has reached a uniform speed, the following step S15 controls the motor such that it rotate at the uniform speed. When the next step 16 determines that the crimper has come to the deceleration starting position, the following step S17 decelerates the motor and step S18 stops the motor rotation based on the arrival at a stopping position.

In the decision section 26, step S19 determines whether the latest crimping operation has been normal based on the data recorded in step S11. Then, the following step S20 displays the results in a crimp monitor 21 and also outputs a warning signal in the case of an abnormal crimping operation.

For determining whether the crimping operation is normal, as shown in FIG, 8A, step S11 records current values (driving current), which are detected in the current detecting section 28 and supplied to the servo-motor 4 at a constant time interval.

Figure 8A:
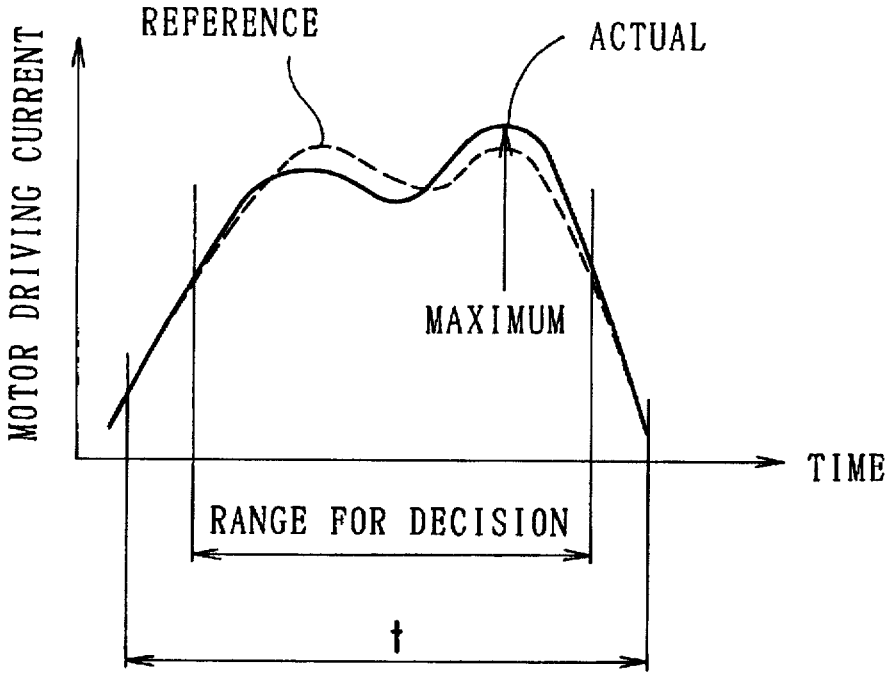
FIG. 8 is a graph explaining a method for determining whether crimping is normal based on the motor driving currents.
FIG. 8B is a graph for explaining a method for determining whether crimping is normal based on the detected crimper heights.

FIG. 8A shows the driving current supplied to the motor 4 at the crimping operation in FIG. 7B. The current control section 25 controls in such way that standard currents, the values of which are stored in the data storage section, are supplied to the motor. In the motor stopping state, a uniform current is supplied to the motor, while the motor driving current changes when the motor begins to rotate to result in a modified control balance. When a terminal is just crimped, if there are no cores in the cable or if an insulated wire is crimped, the supplied current becomes smaller or larger than the standard current in the normal crimping operation. Accordingly, in the present invention, whether the crimping is normal is decided based on thus changed current supplied to the motor.

Figure 8B:
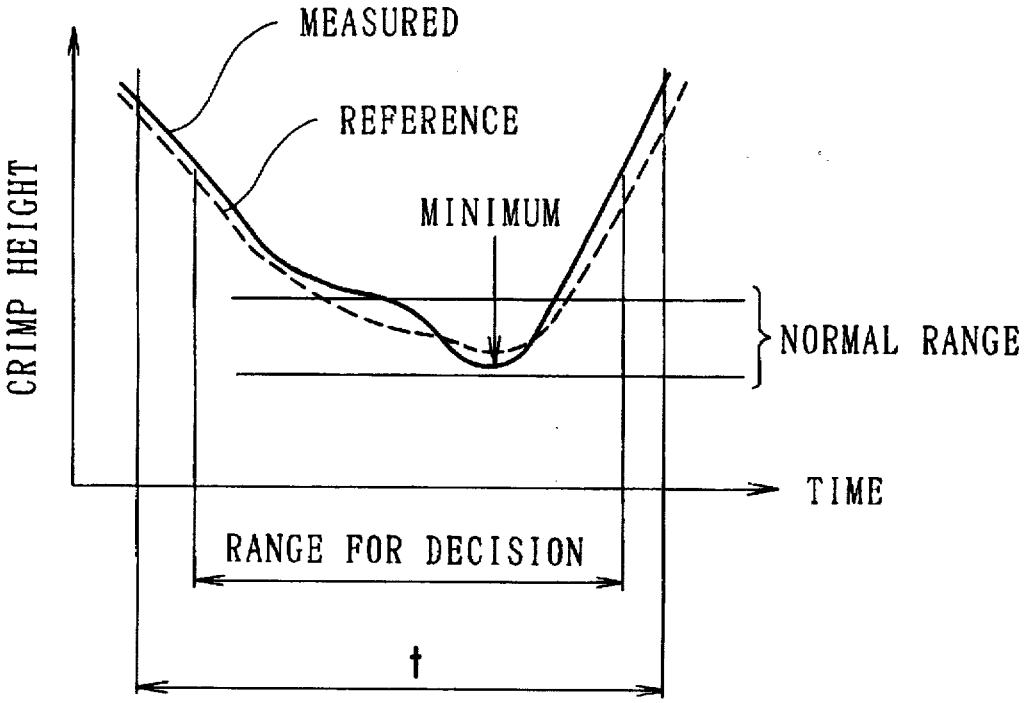
Figure 9:
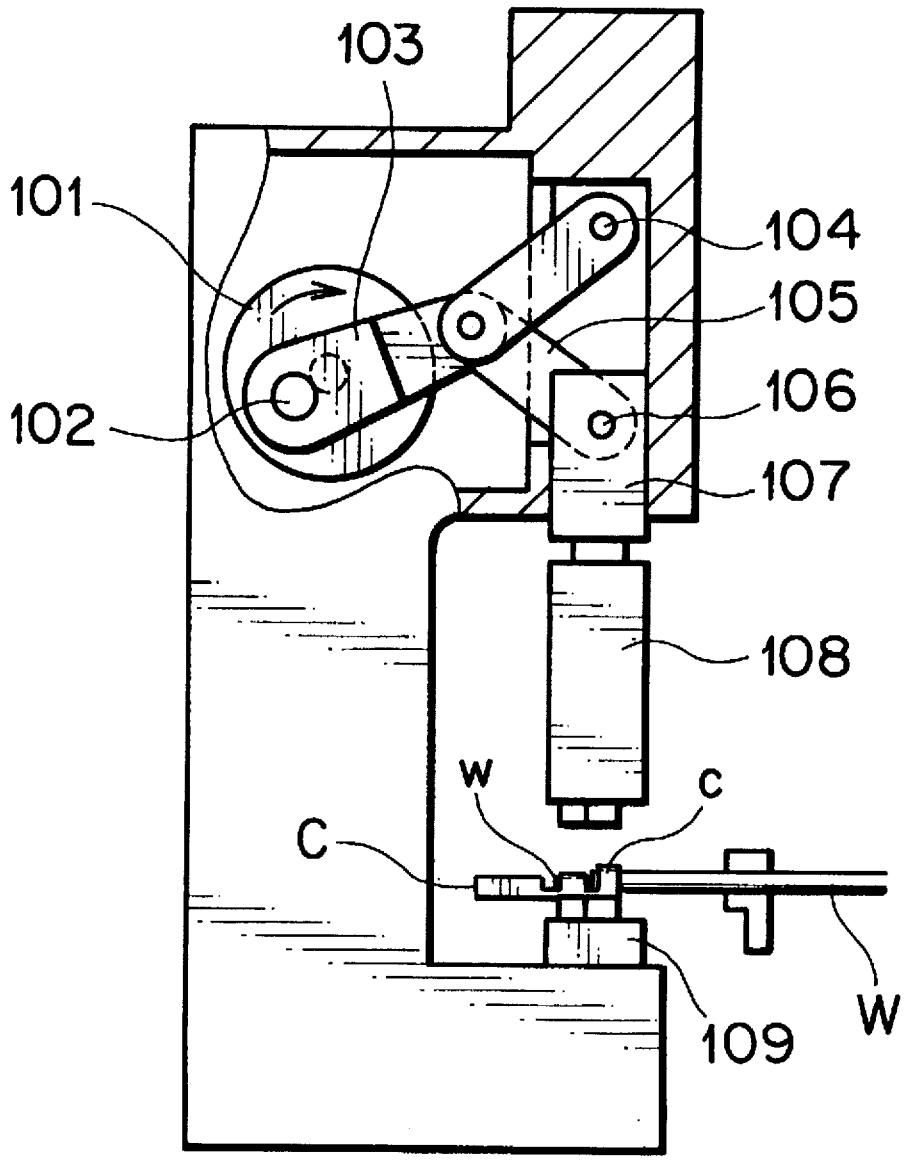
FIG. 9 PRIOR ART
FIG. 9 is an illustration explaining a terminal crimping apparatus of the prior art.
Figure 10:
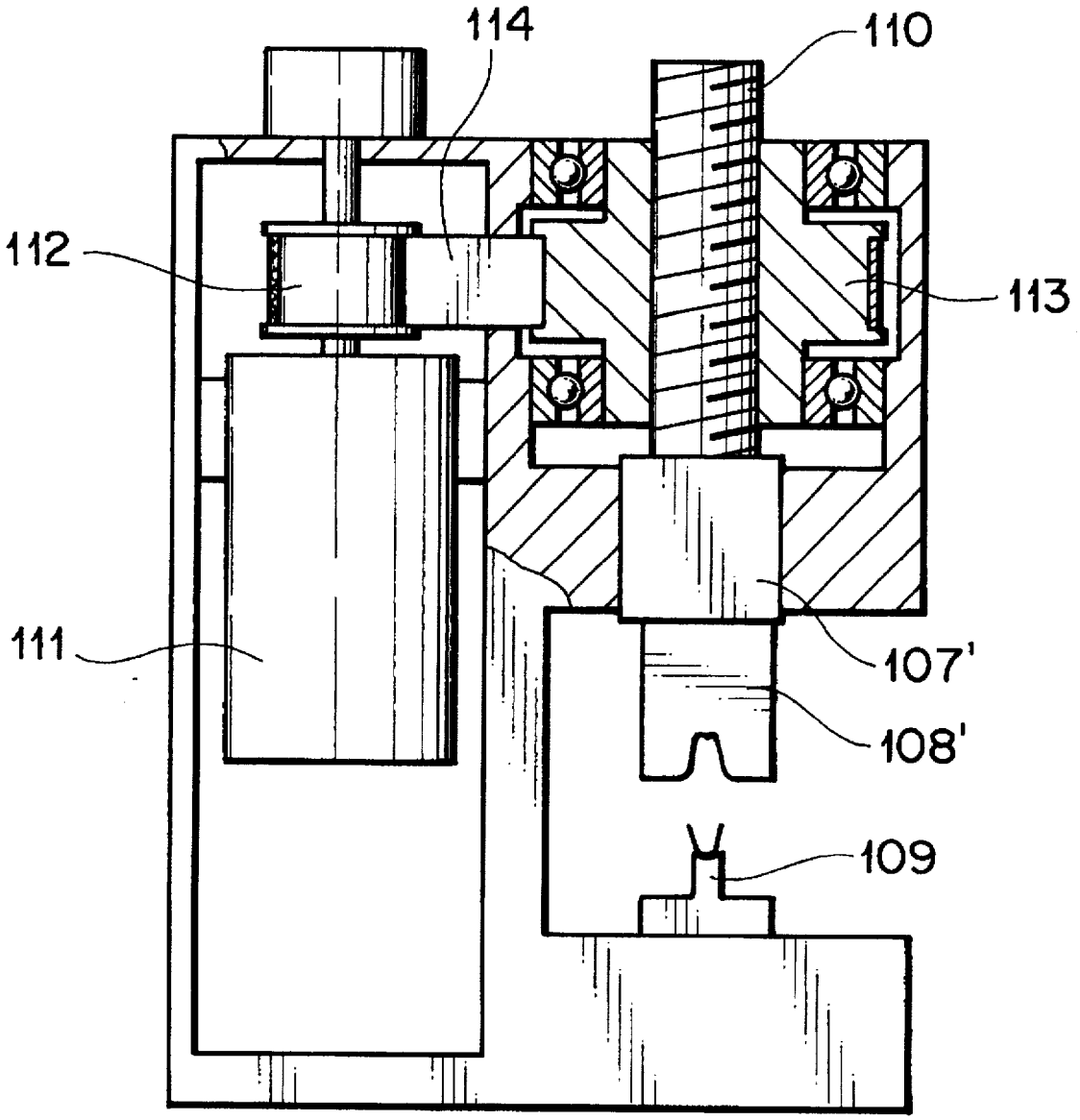
FIG. 10 PRIOR ART
FIG. 10 is an illustration explaining another terminal crimping apparatus of the prior art.
Figure 11:
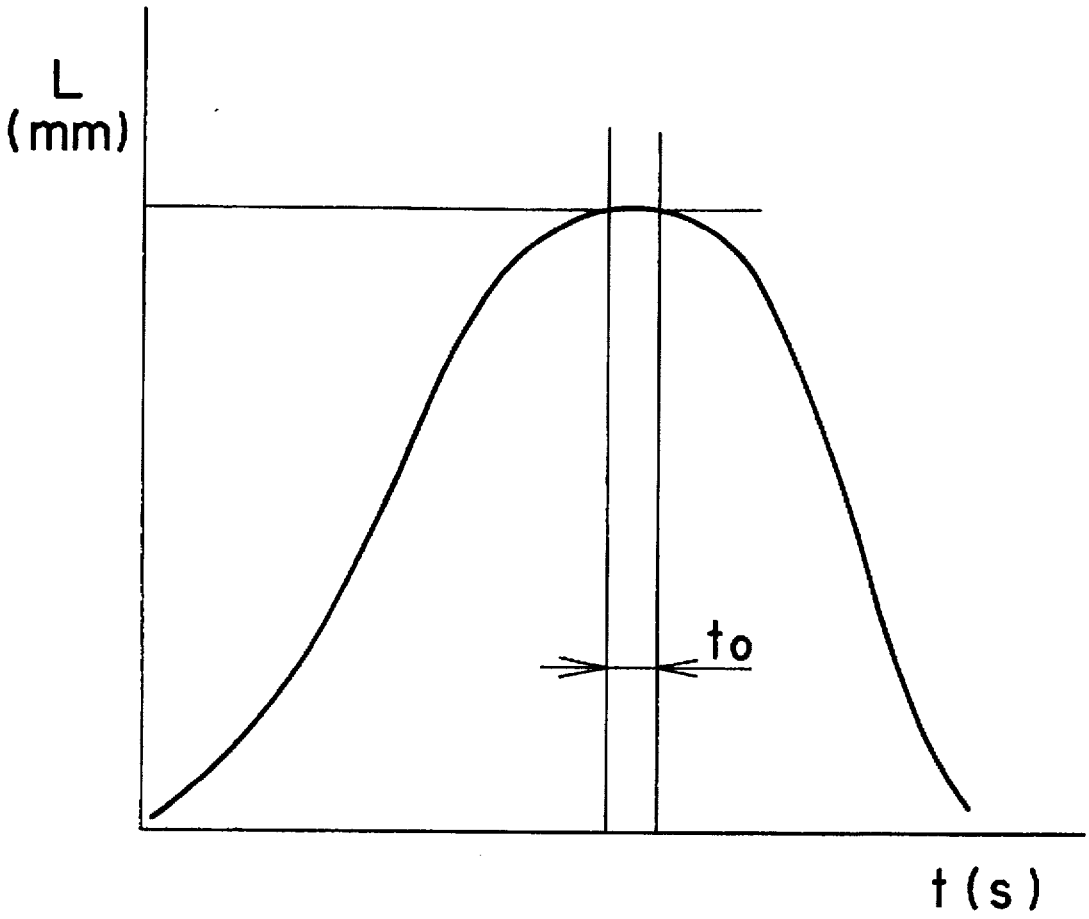
FIG. 11 PRIOR ART
FIG. 11 is a typical graph showing the relation between time and the position of a crimper in a terminal crimping operation regarding a terminal crimping apparatus of the prior art.

Further, FIG. 8B shows an output from the height sensor 32 when a terminal is crimped. Naturally, when a terminal is just crimped, if there are no cores in the cable, or if an insulated wire is crimped, the resulting crimp height outputted at each time interval becomes lower than, or is different from, the normal crimp height. Therefore, in the present invention, whether the crimping is normal is determined based on the thus-changed crimp height.

A first decision method, as shown in FIG. 8A, includes the steps of: reading out a maximum value among driving currents recorded in the step S11 in a predetermined period; determining whether the maximum value is within the standard values stored in the data storage section 23; and determining whether the crimping has been normally carried out based upon whether the maximum value is within the range of the standard values.

A second decision method includes the steps of: recording reference currents during a predetermined period in the data storage section 23; obtaining the differences between the time series current values recorded in the step S11 and the reference currents; and deciding whether the crimping has been normally carried out based upon whether the difference is within a predetermined range.

A third decision method includes the steps of: obtaining the sum of the current values recorded in the step S11 at a constant interval during a predetermined period; and deciding whether the crimping has been normally carried out based upon whether the sum is within a predetermined range.

A fourth decision method includes, as shown in FIG. 8B, the steps of: recording heights outputted from the height sensor 32 by way of I/O 29-5 in data recording of the step S11; obtaining a minimum value among the recorded data; and deciding whether the crimping has been normally carried out based upon whether the minimum value is within a predetermined range.

A fifth decision method includes the steps of: recording heights outputted from the height sensor 32; obtaining a minimum value among the recorded data; and comparing the time series heights with the corresponding reference values, and deciding whether the crimping has been normally carried out based upon whether the differences are within a predetermined range.

Moreover, the decision may be carried out based on both the driving current and the crimper height.

In the embodiment of the present invention, as mentioned above, the off-center pin 8 pivots within the range of 0 to 180 degrees and a crimp height (the lowest position of the crimper 14) is adjusted by the pivoting range of the off-center pin 8. That is, random adjustments of crimp height are capable by controlling the number of rotatione in the servo-motor 4 by the driver control device 34.

Further, monitoring load currents I in the servo-motor 4 or monitoring the height of the crimper 14 can determine whether the crimping operation is normal or not, that is, whether a product is non-defective during crimping operation. Moreover, a stopping period t is provided in crimping operation so that the terminal barrel is prevented from its spring-back, resulting in reliable stable crimping and reliable products.

In the above-mentioned crimping method, the normally and reversely rotating electrical servo-motor 4 is adopted to vertically reciprocate the crimper 14, the electrical servo-motor may be replaced by a hydrostatic servo-motor.

What is claimed is:

1. An apparatus for crimping a terminal to a stripped electrical wire comprising:

a vertically reciprocatable crimper operative to crimp the terminal to conductors of said wire;

an anvil opposing said crimper; and means for vertically reciprocating said crimper with respect to said anvil including:

a vertically movable ram connected to said crimper, a piston-crank mechanism for driving said ram, a circular plate mounted for rotation and connecting said piston-crank mechanism for vertical reciprocating movement upon rotation of said circular plate in forward and reverse directions, means for driving said circular plate in alternate forward and reverse directions including a servo-motor and a reduction gear connected between said servo-motor and said circular plate; and a control means including means for stopping said servo-motor during a given time period when said crimper is positioned at its lowest position.

2. The apparatus as claimed in claim 1, wherein said circular plate has an off-center pin and a crank arm, one end of which is pivotably attached to said off-center pin and the other end of which is pivotably attached to said ram.

3. The apparatus as claimed in claim 1, wherein said circular plate is operative to pivot forwardly and reversely within an angular range of 0 to 180 degrees by the rotation of said servo-motor.

4. The apparatus as claimed in claim 1, wherein the lowest position of said crimper is determined by a predetermined pivoting angle of said circular plate to adjust a crimp height for the terminal.

5. The apparatus as claimed in claim 4, wherein the predetermined pivoting angle of said circular plate is between 150 to 180 degrees.

6. The apparatus as claimed in claim 1, further comprising a control means operative to control the rotating speed of said servo-motor, said control means including means for decelerating said servo-motor prior to engagement of said crimper with said terminal, means for stopping said servo-motor during said given time period at the lowest position of said crimper; and means for reversely rotating said servo-motor to return said crimper to its top position.

7. The apparatus as claimed in claim 1, further comprising means for comparing a load current applied to said servo-motor with an upper or lower limit of reference load currents.

8. The apparatus as claimed in claim 7, further comprising a temperature correction means operative to detect a temperature of a motor coil of said servo-motor and means for correcting said load current applied to said servo-motor in response to a correction obtained by comparing a detected temperature to a corresponding load current in a reference temperature.

9. The apparatus as claimed in claim 1, further comprising a speed control means operative to control vertically reciprocating speeds of said crimper, said speed control means including a rotary encoder attached to a rotation axis of said servo-motor, and a position-detecting means for detecting positions of said crimper based on a detected number of rotations of said rotary encoder; and means controlling said vertically reciprocating speeds of said crimper based on a comparison of the position detected by said position-detecting means to predetermined reference speeds.

* * * * *